US012226669B2

(12) United States Patent
Hsu

(10) Patent No.: US 12,226,669 B2
(45) Date of Patent: Feb. 18, 2025

(54) CLIMBING MACHINE WITH TWO SLIDE BASES

(71) Applicant: Chih-Yung Hsu, Tainan (TW)

(72) Inventor: Chih-Yung Hsu, Tainan (TW)

( * ) Notice: Subject to any disclaimer, the term of this patent is extended or adjusted under 35 U.S.C. 154(b) by 185 days.

(21) Appl. No.: 17/961,266

(22) Filed: Oct. 6, 2022

(65) Prior Publication Data

US 2024/0115902 A1 Apr. 11, 2024

(51) Int. Cl.
*A63B 22/04* (2006.01)
*A63B 21/00* (2006.01)

(52) U.S. Cl.
CPC ..... *A63B 22/04* (2013.01); *A63B 21/00069* (2013.01)

(58) Field of Classification Search
CPC . A63B 22/04; A63B 21/00069; A63B 22/205; A63B 2225/09; A63B 21/4035; A63B 21/4045
See application file for complete search history.

(56) References Cited

U.S. PATENT DOCUMENTS 5,222,927 A * 6/1993 Chang ..... A63B 22/0002 482/53
D355,228 S * 2/1995 Hung ..... D21/670
10,179,260 B1 * 1/2019 Stearns ..... A63B 21/4034
10,792,536 B2 10/2020 Liu
11,389,692 B2 * 7/2022 Stearns ..... A63B 23/03575
11,446,544 B2 * 9/2022 Carruthers ..... A63B 21/4035
11,458,358 B1 * 10/2022 Stearns ..... A63B 22/001
11,484,750 B2 * 11/2022 Silver ..... A63B 21/00069
11,529,547 B1 * 12/2022 Stearns ..... A63B 21/4045
11,738,235 B2 * 8/2023 Stearns ..... A63B 21/068 482/52
11,918,852 B1 * 3/2024 Stearns ..... A63B 22/001
11,980,788 B1 * 5/2024 Maresh ..... A63B 22/0664
2015/0343259 A1 * 12/2015 Mercenari Uribe ..... A63B 23/03516 482/52
2020/0094106 A1 * 3/2020 Liu ..... A63B 21/4034
2020/0171346 A1 * 6/2020 Chen ..... A63B 22/205
2021/0220696 A1 * 7/2021 Carruthers ..... A63B 21/00069
2021/0291016 A1 * 9/2021 Zhou ..... A63B 21/0557
2023/0310925 A1 * 10/2023 Hsu ..... A63B 22/205 482/52
2023/0381575 A1 * 11/2023 Hsu ..... A63B 21/4034

FOREIGN PATENT DOCUMENTS

TW M629789 U 7/2022
WO WO2021164384 A1 8/2021

* cited by examiner

*Primary Examiner* — Andrew S Lo
(74) *Attorney, Agent, or Firm* — Muncy, Geissler, Olds & Lowe, P.C.

(57) ABSTRACT

A climbing machine with two slide bases provides for a user to operate in a standing posture. The climbing machine with two slide bases includes a seat, a primary bracket, a first slide rail, a first slide base, a second slide rail, a second slide base, a transmission unit, a first handle, a first pedal, a second handle, a second pedal, and a resistance unit. By the climbing machine with two slide bases, one can simulate the training of synchronous coordination of the movements of hands and feet in rock climbing and mountaineering. In addition, the size of the climbing machine can be reduced considerably to save the space of use.

8 Claims, 17 Drawing Sheets

CLIMBING MACHINE WITH TWO SLIDE BASES

BACKGROUND OF THE INVENTION

(a) Field of the Invention

The present invention relates to a climbing machine with two slide bases, and more particularly to a climbing machine which is provided with a single compact primary bracket, two slide bases that slide steadily, and two handles that are connected alternately. The climbing machine can be used to train limbs, is simple in the entire structure and can be operated coordinately.

(b) Description of the Prior Art

Due to the limitation of outdoor fields and weather, and to improve the general mood of indoor exercising, the climbing machine that can simulate rock climbing and mountaineering can be used to practice effectively the synchronous coordination of the movements of hands and feet while doing the rock climbing and mountaineering, thereby achieving the purpose of exercising.

A US patent U.S. Ser. No. 10/792,53662, a climbing machine, discloses a structure to train limbs simultaneously. The climbing machine includes a resistance device, a driving device, and two climbing devices. The driving device comprises an upper wheel set, an axial wheel set, and a lower wheel set. The axial wheel set includes a first axial wheel and a second axial wheel. Through a plurality of connecting members, the alternate up and down movements of the climbing device drive the upper wheel set and the lower wheel set to rotate in a first direction, the upper wheel set drives the first axial wheel to rotate in a second direction, and the lower wheel set drives the second axial wheel to rotate in the first direction.

A climbing machine in the prior art of this patent includes two uprights that are disposed parallel on left and right sides. The entire structure takes more space, is large, heavy, and not emplaced and moved easily. In addition, as plural sets of transmission members and chains are used to transmit the handles and the pedals, the structure is more complicated. In particular, when using the climbing machine, the left hand and the left foot of a user move up and down simultaneously, and the right hand and the right foot of the user also move up and down simultaneously. This mode of operation does not conform the way of natural movements of the limbs.

On the other hand, a patent WO2021164384A1 discloses a climbing machine, including a rotatable rotation shaft, a plurality of one-way components capable of achieving one-way transmission, a plurality of transmission units and a plurality of climbing points. The one-way components are connected to the rotation shaft in a sleeving manner, each transmission unit is connected to one climbing point, and each transmission unit and the rotation shaft form the one-way transmission by means of being connected to one one-way component; in one rotating direction, the rotation shaft and the transmission units can be in transmission, and the climbing points descend during transmission; and in the direction opposite to the rotating direction, the transmission between the rotation shaft and the transmission units cannot be achieved. By using the climbing machine, a user can experience a vivid feeling of climbing upwards, thereby improving the climbing experience.

As shown in the WO2021164384A1 patent, four climbing points are provided in the patent. Each climbing point provides for a user's two feet to step on and two hands to hold on, to simulate climbing. However, in this patent, four sets of closed transmission members are used to drive four sliding blocks, and the four sliding blocks are secured on the abovementioned four climbing points. Therefore, the structure is rather complicated.

SUMMARY OF THE INVENTION

Accordingly, to solve the abovementioned shortcomings in the existing climbing machines, the present invention provides a climbing machine with two slide bases for a user to operate in a standing posture, with a direction to which the user's shoulder width extends when the user operates being defined as a transversal direction. The climbing machine with two slide bases comprises a seat; a primary bracket which is positioned with an upright direction on the seat and disposed on a central location in the transversal direction, with the primary bracket being divided into a first side and a second side in the transversal direction; a first slide rail, which is fixed on the primary bracket on the first side in the upright direction of the primary bracket; a first slide base, which is slidingly disposed on the first slide rail; a second slide rail, which is fixed on the primary bracket on the second side in the upright direction of the primary bracket; a second slide base, which is slidingly disposed on the second slide rail; a transmission unit, which is disposed on the primary bracket, with the first slide base and the second slide base being connected to the transmission unit and sliding in a direction opposite to each other; a first handle, which includes a first grip, with the first grip being disposed on the first side and the first handle being fixed on the second slide base; a first pedal, which is fixed on the first slide base on the first side; a second handle, which includes a second grip, with the second grip being disposed on the second side and the second handle being fixed on the first slide base; a second pedal, which is fixed on the second slide base on the second side; and a resistance unit, which is disposed on the seat or the primary bracket and is connected to the transmission unit to provide a resistance to the transmission unit.

The abovementioned transmission unit includes an upper transmission wheel, a lower transmission wheel and a transmission member. The upper transmission wheel is disposed on one end of the primary bracket, the lower transmission wheel is disposed on the other end of the primary bracket, and the transmission member is sheathed between the upper transmission wheel and the lower transmission wheel. The first slide base and the second slide base are connected respectively to the transmission member, the lower transmission wheel drives simultaneously the upper transmission wheel to rotate back and forth in a limited degree through the transmission member, thereby driving the first slide base and the second slide base to slide.

The abovementioned upper transmission wheel is disposed on one end of the primary bracket by an upper shaft, and the lower transmission wheel is disposed on the other end of the primary bracket by a lower shaft.

An axis connecting line between an axle center of the upper shaft and an axle center of the lower shaft divides the transmission member into a first section on the first side, and a second section on the second side. The first slide base is connected to the first section, and the second slide base is connected to the second section.

The abovementioned seat is put up additionally with a secondary bracket. The resistance unit is disposed between the primary bracket and the secondary bracket, and includes a driving wheel, a belt, a resistance wheel and a magnetic resistor. The driving wheel is fixed on the lower shaft, and rotates back and forth simultaneously along with the lower shaft. The driving wheel and the resistance wheel are rotatably disposed between the primary bracket and the secondary bracket, the belt is sheathed between the driving wheel and the resistance wheel, and the magnetic resistor is rotatably disposed on the secondary bracket, allowing the resistance wheel to acquire a changeable resistance. The resistance is transmitted by the resistance wheel through the belt and the driving wheel, and is transmitted to the first handle, the first pedal, the second handle and the second pedal through the transmission member, the first slide base and the second slide base.

The abovementioned first slide base is oppositely provided with a first securing portion and a third securing portion; whereas, the second slide base is oppositely provided with a second securing portion and a fourth securing portion. The transmission member includes a first transmission piece and a second transmission piece, the first transmission piece is sheathed on the upper transmission wheel, two ends of the first transmission piece are provided respectively with a first securing end and a second securing end, the first securing end is connected to the first securing portion, and the second securing end is connected to the second securing portion. The second transmission piece is sheathed on the lower transmission wheel, two ends of the second transmission piece are provided respectively with a third securing end and a fourth securing end, the third securing end is connected to the third securing portion, and the fourth securing end is connected to the fourth securing portion.

The abovementioned upper transmission wheel and lower transmission are a timing belt pulley, a gear, a belt pulley, or a cable pulley.

The abovementioned first transmission piece and second transmission piece are a timing belt, a chain, a belt, or a cable.

One end of the abovementioned first handle is fixed on the second slide base by a first link rod, and the first grip is fixed on the other end of the first handle in an upward and downward adjustable manner. On the other hand, one end of the second handle is fixed on the second slide base by a second link rod, and the second grip is fixed on the other end of the second handle in an upward and downward adjustable manner.

The abovementioned primary bracket is provided with an auxiliary frame on an end away from the seat. The auxiliary frame is provided with a display unit at a location away from a user. A distance between the first handle and the second handle is larger than a width of the display unit in the transversal direction.

Inner rims of the abovementioned first slide base and second slide base are provided respectively with a roller, and the first slide base and the second slide base slide on the first slide rail and the second slide rail correspondingly by the rollers.

The inner rims of the abovementioned first slide base and second slide base are provided respectively with a sleeve, and the first slide base and the second slide base slide on the first slide rail and the second slide rail correspondingly by the sleeves.

The abovementioned technical features are provided with following advantages:

1. The first slide rail and the second slide rail are fixed on a single primary bracket; therefore, the size is compact without taking up space. In the present invention, only one primary bracket is provided, and the first slide rail, the first slide base, the second slide rail, the second slide base, and the transmission unit are all disposed at a center line location of the user's vertical torso, which reduces the volume of the climbing machine considerably to save the space of use.
2. The first slide base and the second slide base slide on their dedicated first slide rail and second slide rail; therefore, the sliding is steady and does not wobble easily, with a good effect of stable operation. In particular, the breadth that is taken up by the first slide base, the first slide rail, the primary bracket, the second slide rail and the second slide base in the transversal direction (i.e., the direction of the user's shoulder width in operation) is very small, without completely interfering the normal swaying of both feet and both hands of the user.
3. The first handle and the second handle are connected respectively to the first slide base and the second slide base on the other side in an X-shaped manner; whereas, the first pedal and the second pedal are connected to the first slide base and the second slide base on the same side. Therefore, in operation, the left hand and the left foot of the user are always close to each other and away from each other, and the right hand and the right foot are always close to each other and away from each other, which avoids the operation mode that the left hand and the left foot move up and down simultaneously, and the right hand and the right foot move up and down at a same time. By the simple structure, the present invention provides the user with the operation mode that the limbs can move naturally.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

Figure 1:
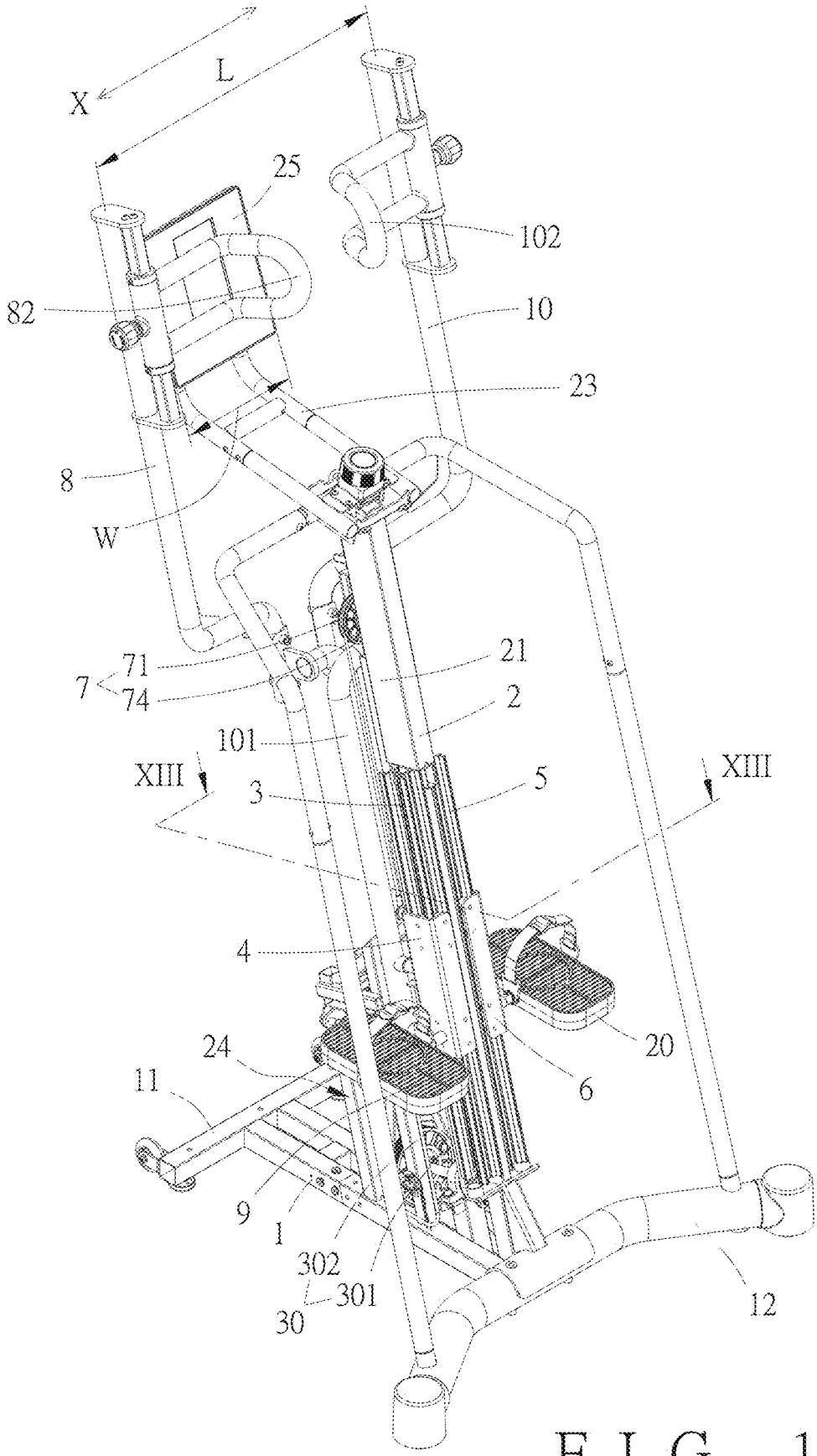
FIG. 1 shows a three-dimensional view of an embodiment of the present invention.
Figure 1A:
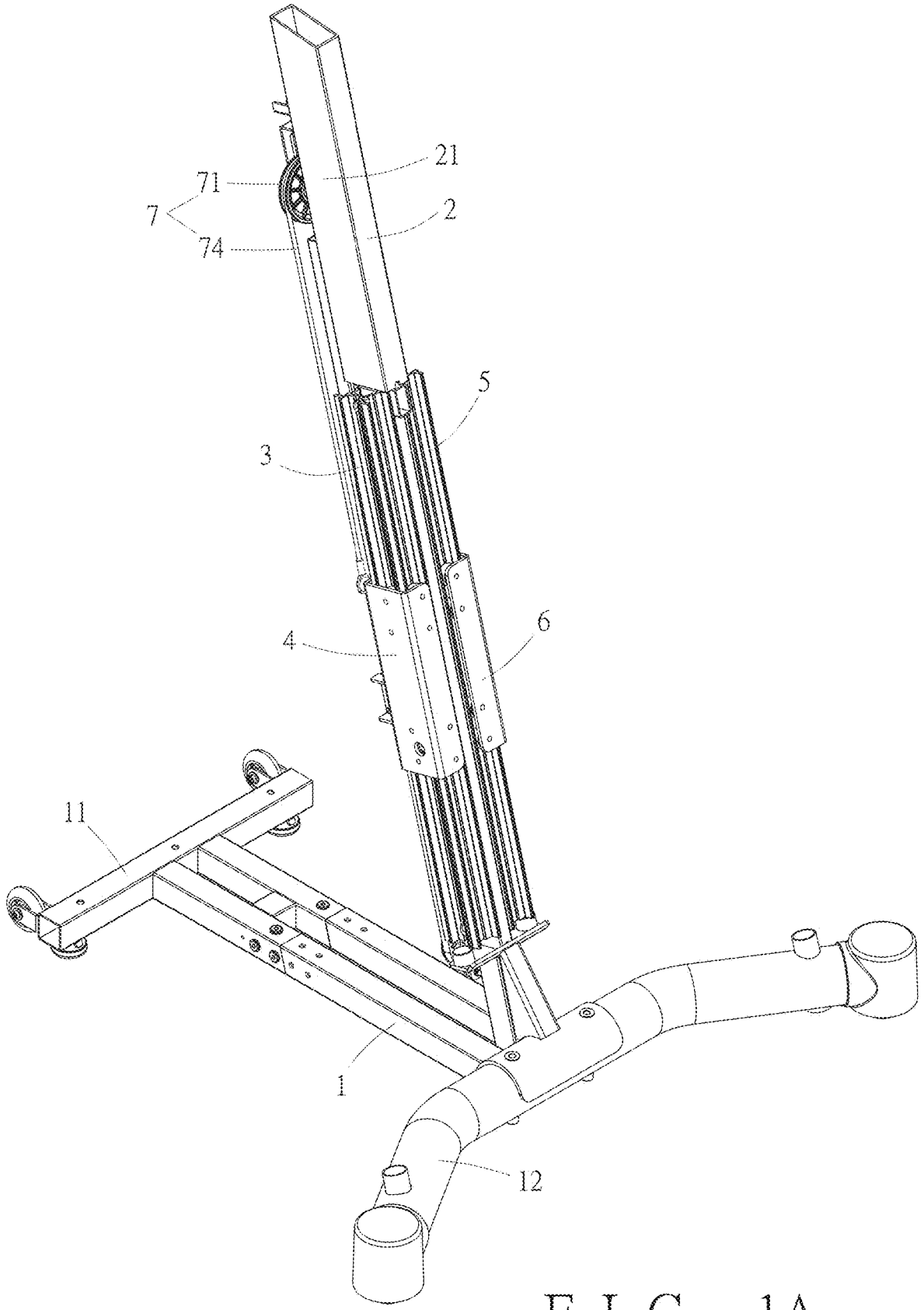
FIG. 1A shows a schematic view of a seat, a primary bracket, a first slide rail, a second slide rail, a first slide base, a second slide base, and a transmission unit, according to the embodiment of the present invention.

In the specification of the present invention, the terms of direction, such as front, rear, left, right, up, down, and center, are all the orientations that a user feels when the user operates the present invention in a standing posture, and looks to the front. These terms of direction are only used as a convenient way to describe the spatial location of the present invention, and are not used to limit the scope of the present invention.

Referring to FIG. 1, FIG. 1A, FIG. 2 and FIG. 3, the present embodiment discloses a climbing machine with two slide bases, providing for a user F to operate in a standing posture. A direction to which the user's shoulder width extends when the user F is operating the climbing machine is defined as the transversal direction X. The climbing machine with two slide bases comprises a seat 1, a primary bracket 2, a first slide rail 3, a first slide base 4, a second slide rail 5, a second slide base 6, a transmission unit 7, a first handle 8, a first pedal 9, a second handle 10, a second pedal 20, and a resistance unit 30.

The seat 1 is provided with a first strut 11 and a second strut 12 that are disposed oppositely with respect to each other on a front and rear side. The seat 1 can be put upright on a plane stably, such as ground. However, the seat 1 can be in other geometries, and is not limited to the present embodiment.

Figure 2:
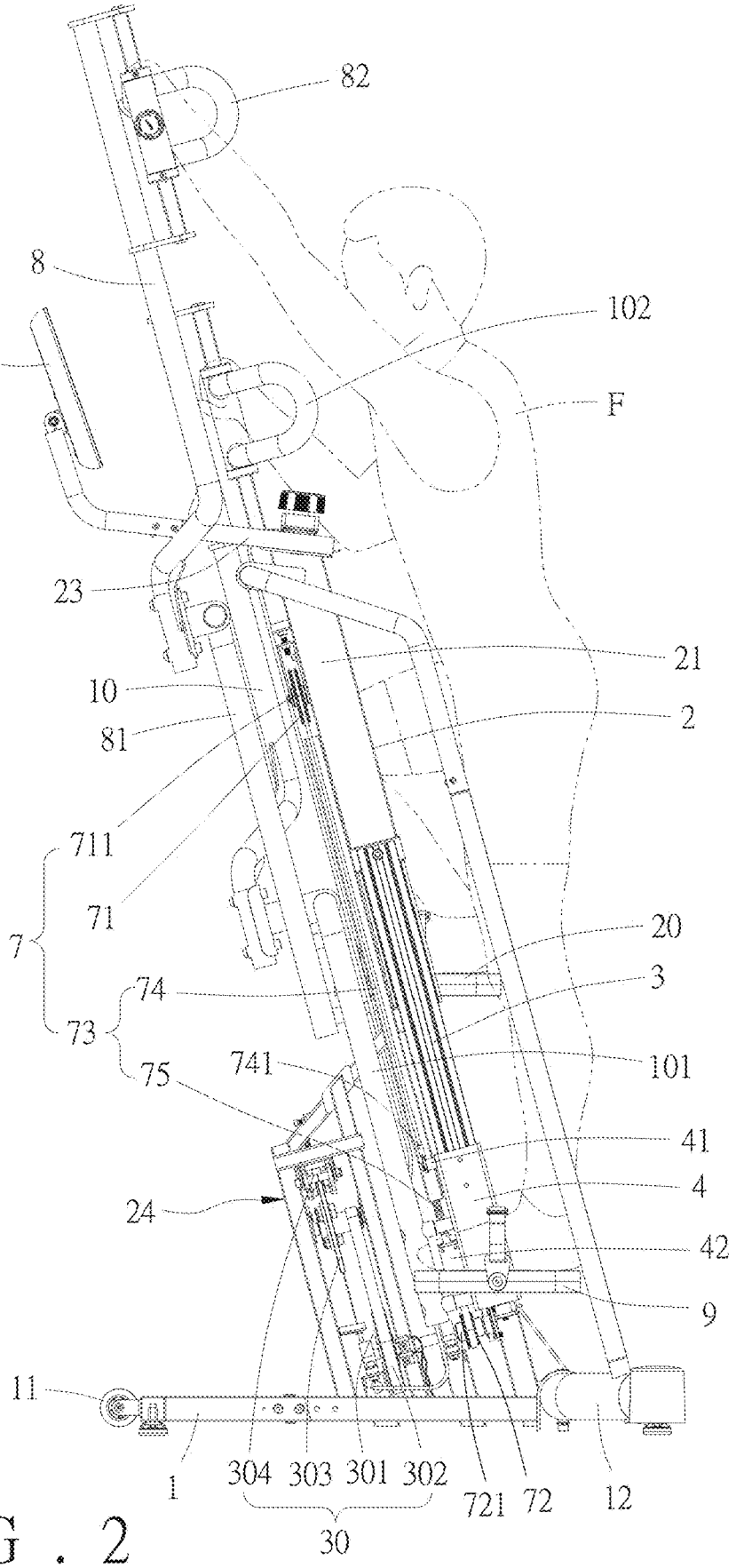
FIG. 2 shows a side view of use of the embodiment of the present invention.
Figure 3:
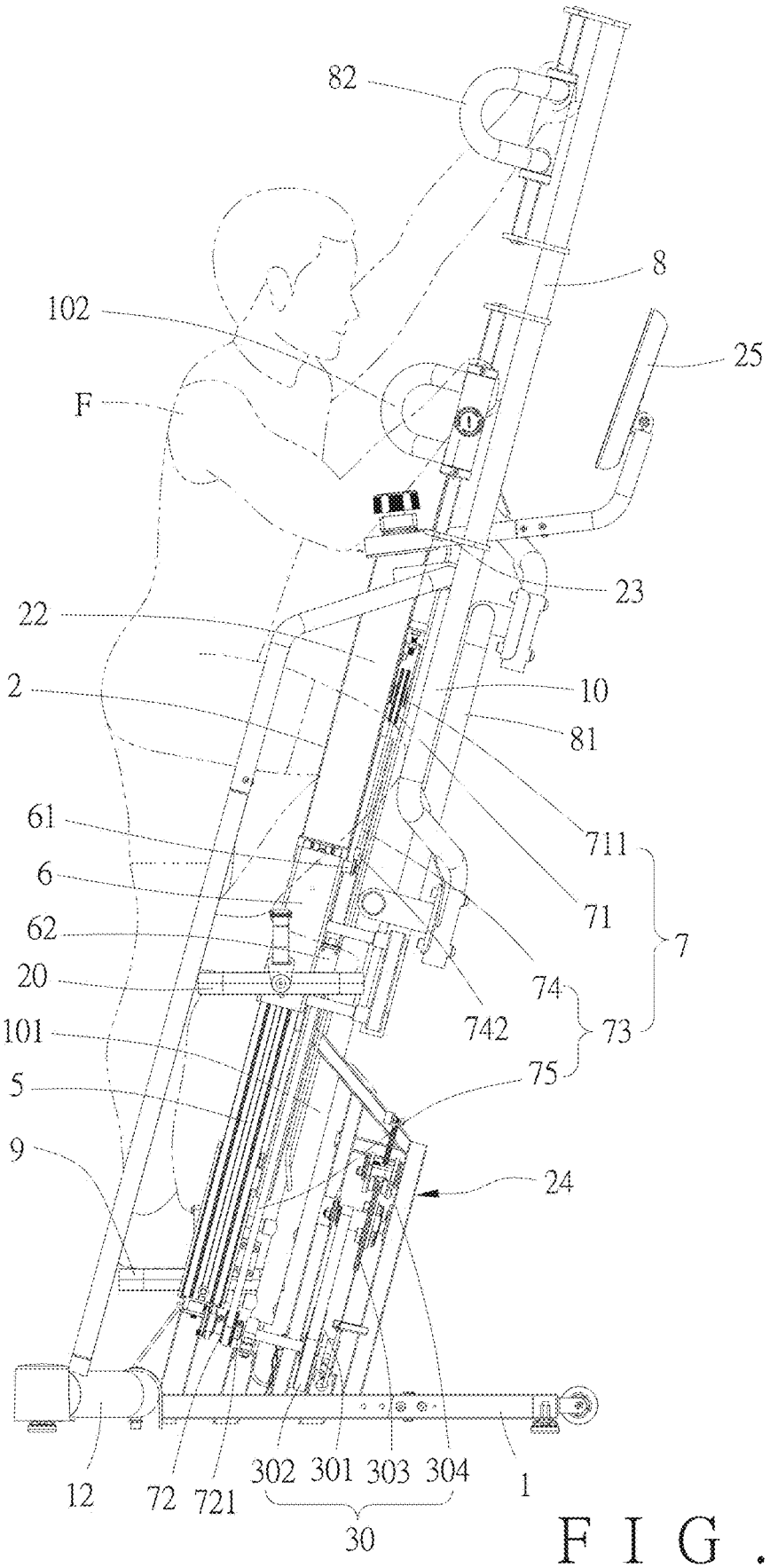
FIG. 3 is another side view of use of the embodiment of the present invention.
Figure 4:
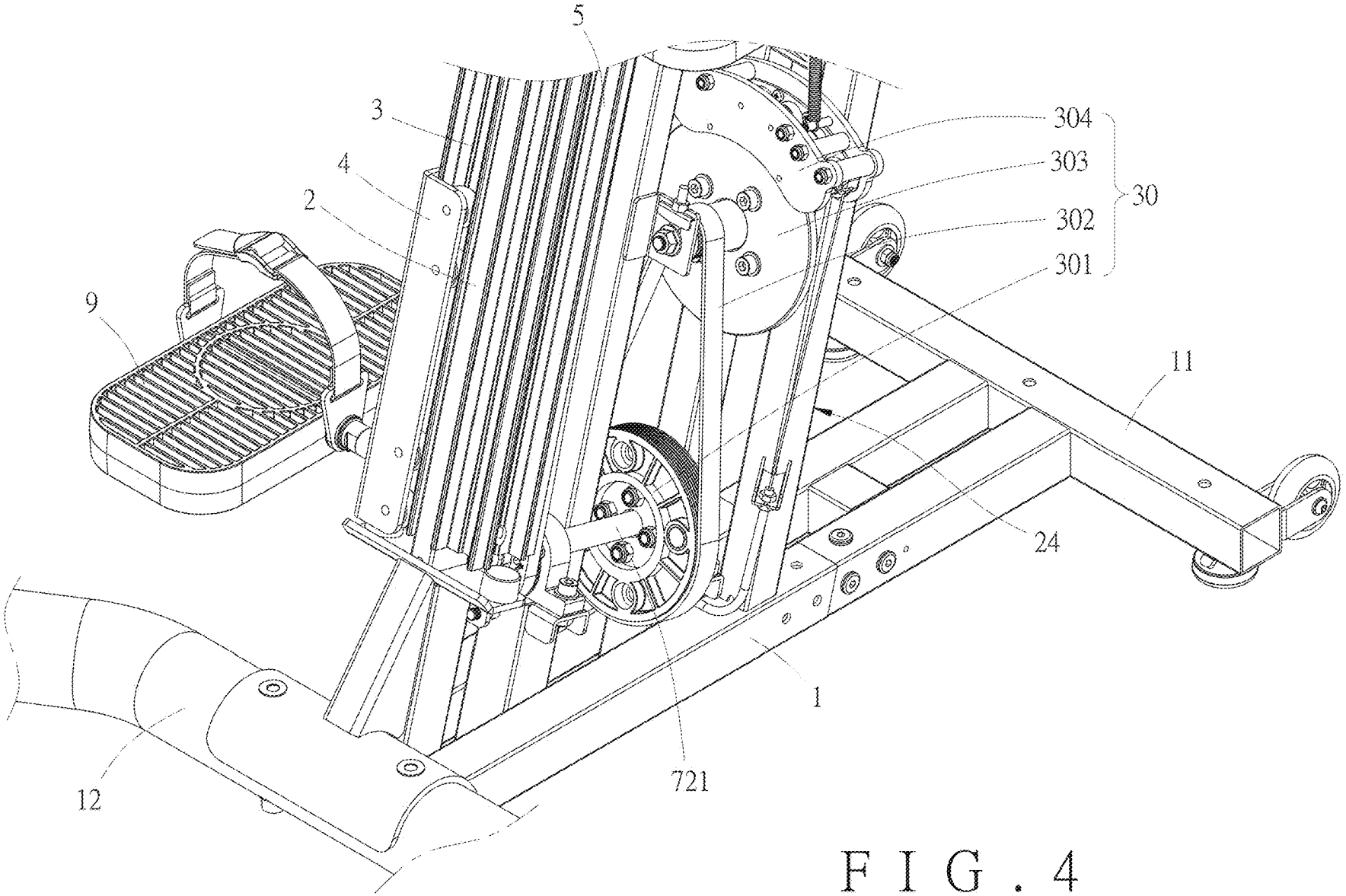
FIG. 4 is a structural view of a resistance unit of the embodiment of the present invention.
Figure 4A:
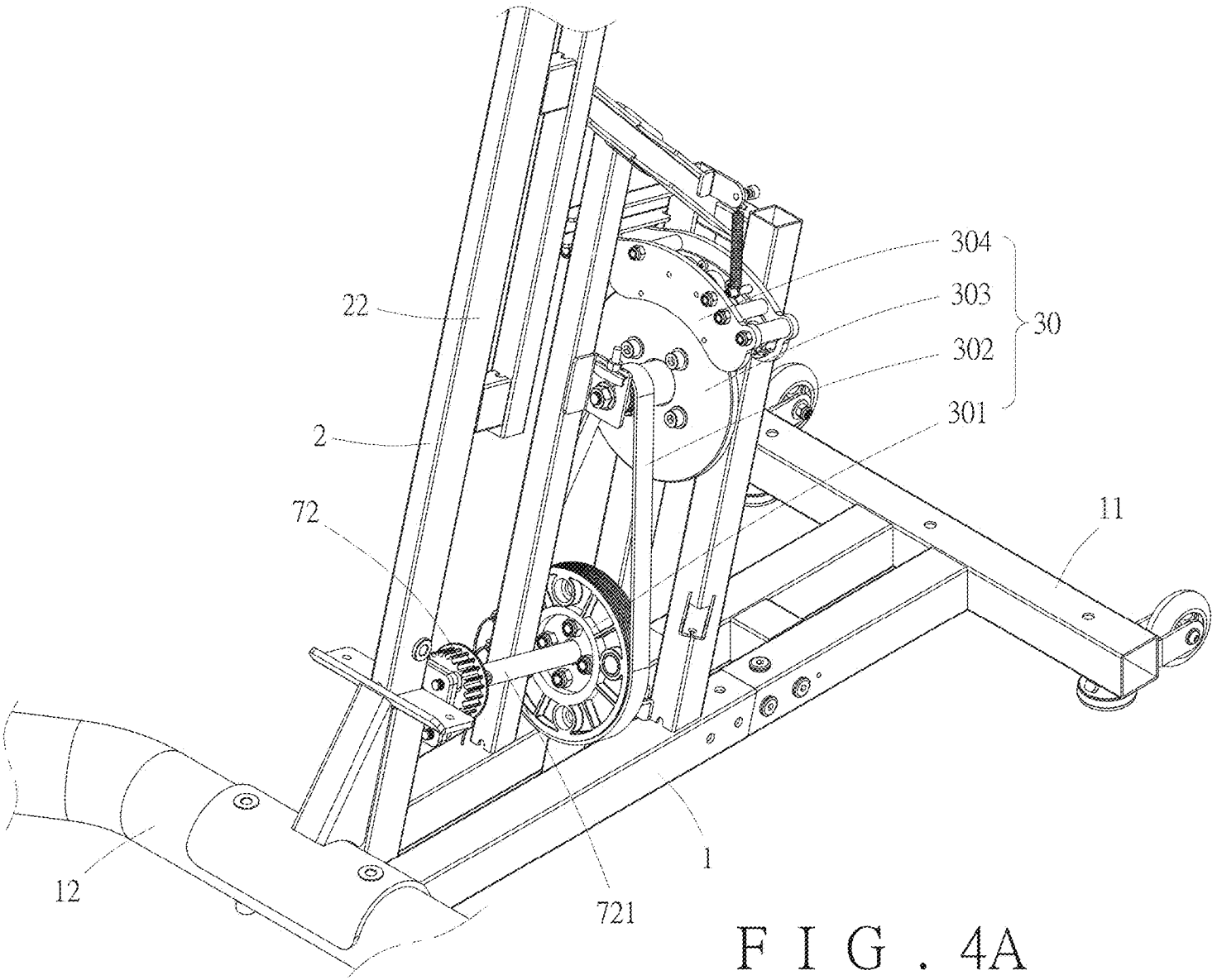
FIG. 4A shows the other structural view of the resistance unit of the embodiment of the present invention (removing the first slide rail, the first slide base, the second slide rail and a first pedal in FIG. 4).
Figure 5:
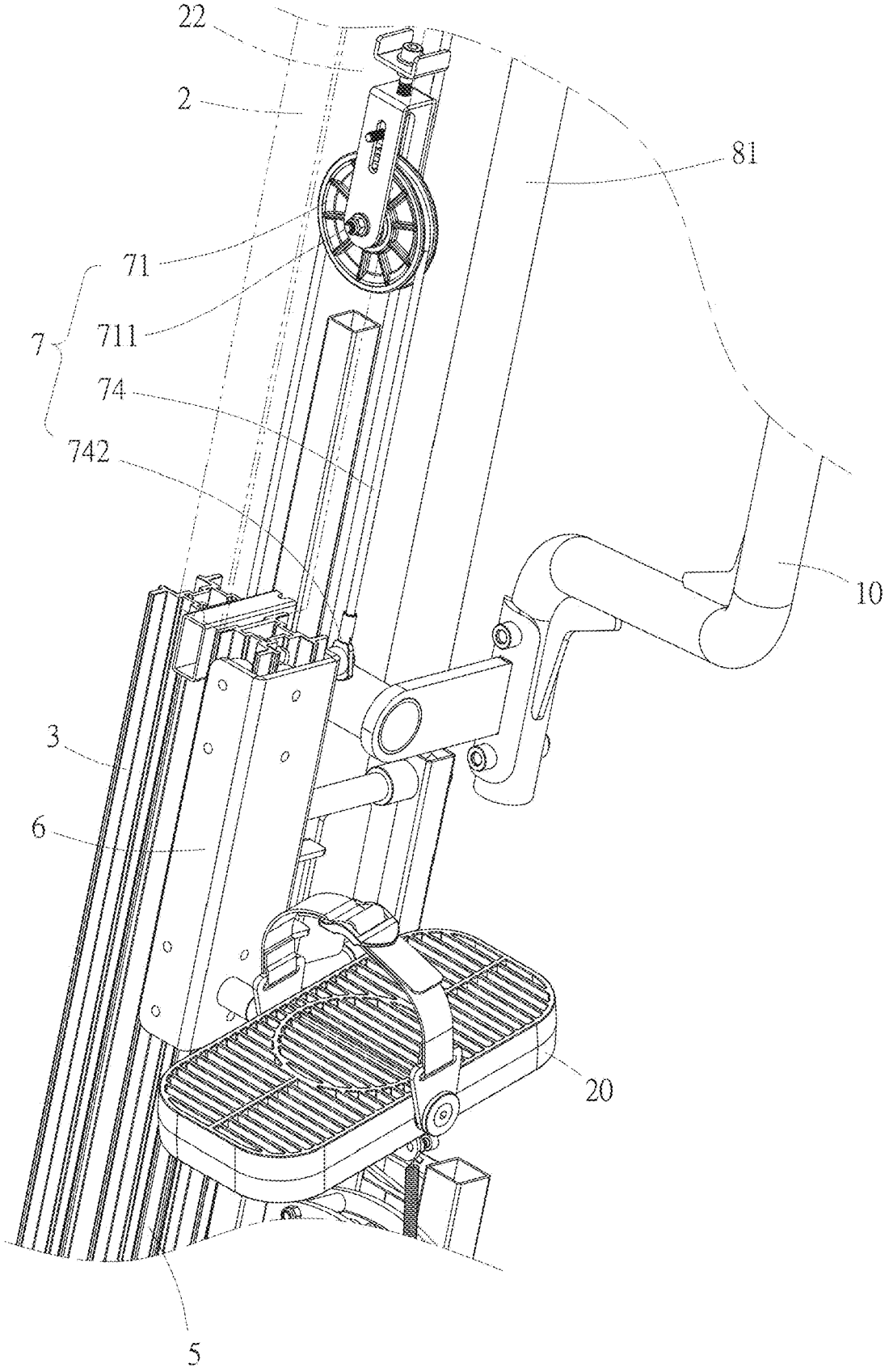
FIG. 5 is a schematic view of the embodiment of the present invention, showing that a first transmission piece is fixed on the second slide base.

The primary bracket 2 is positioned with an upright direction on the seat 1, and is disposed on a central location of the seat 1 in the transversal direction X. The primary bracket 2 is divided into a first side 21 and a second side 22 in the transversal direction X. As shown in FIG. 2 and FIG. 3, the first side 21 is on the left side of the user F in operation, and the second side 22 is on the right side of the user F in operation. The primary bracket 2 is provided with an auxiliary frame 23 on an end away from the seat 1, and a front side of the primary bracket 2 is provided with a secondary bracket 24. The secondary bracket 24 is used to fix the resistance unit 30. In front of the auxiliary frame 23 and away from the user F, a display unit 25 is disposed, displaying a sport information, an entertainment information, a teach information or a network information.

The first slide rail 3 is fixed to the primary bracket 2 on the first side 21 along the upright direction of the primary bracket 2, and is disposed on the left side of the user F.

The first slide base 4 is slidingly disposed on the first slide rail 3, and is provided oppositely with a first securing portion 41 and a third securing portion 42.

The second slide rail 5 is fixed to the primary bracket 2 on the second side 22 along the upright direction of the primary bracket 2, and is disposed on the right side of the user F.

The second slide base 6 is slidingly disposed on the second slide rail 5, and is provided oppositely with a second securing portion 61 and a fourth securing portion 62.

The transmission unit 7 is disposed on a front side of the primary bracket 2. As shown in FIG. 4, FIG. 5, FIG. 6 and FIG. 7, the transmission unit 7 includes an upper transmission wheel 71, a lower transmission wheel 72, and a transmission member 73. The upper transmission wheel 71 is disposed on one end of the primary bracket 2 by an upper shaft 711, the lower transmission wheel 72 is disposed on the other end of the primary bracket 2 by a lower shaft 721, and the transmission member 73 includes a first transmission piece 74 and a second transmission piece 75. The first transmission piece 74 is sheathed on the upper transmission wheel 71, and two ends of the first transmission piece 74 are provided respectively with a first securing end 741 and a second securing end 742. The first securing end 741 is connected to the first securing portion 41 of the first slide base 4, and the second securing end 742 is connected to the second securing portion 61 of the second slide base 6. The second transmission piece 75 is sheathed on the lower transmission wheel 72, and two ends of the second transmission piece 75 are provided respectively with a third securing end 751 and a fourth securing end 752. The third securing end 751 is connected to the third securing portion 42 of the first slide base 4, and the fourth securing end 752 is connected to the fourth securing portion 62 of the second slide base 6. The upper transmission wheel 71 and the lower transmission wheel 72 are a timing belt pulley, a gear, a belt pulley, or a cable pulley. The first transmission piece 74 and the second transmission piece 75 are a timing belt, a chain, a belt, or a cable.

Figure 6:
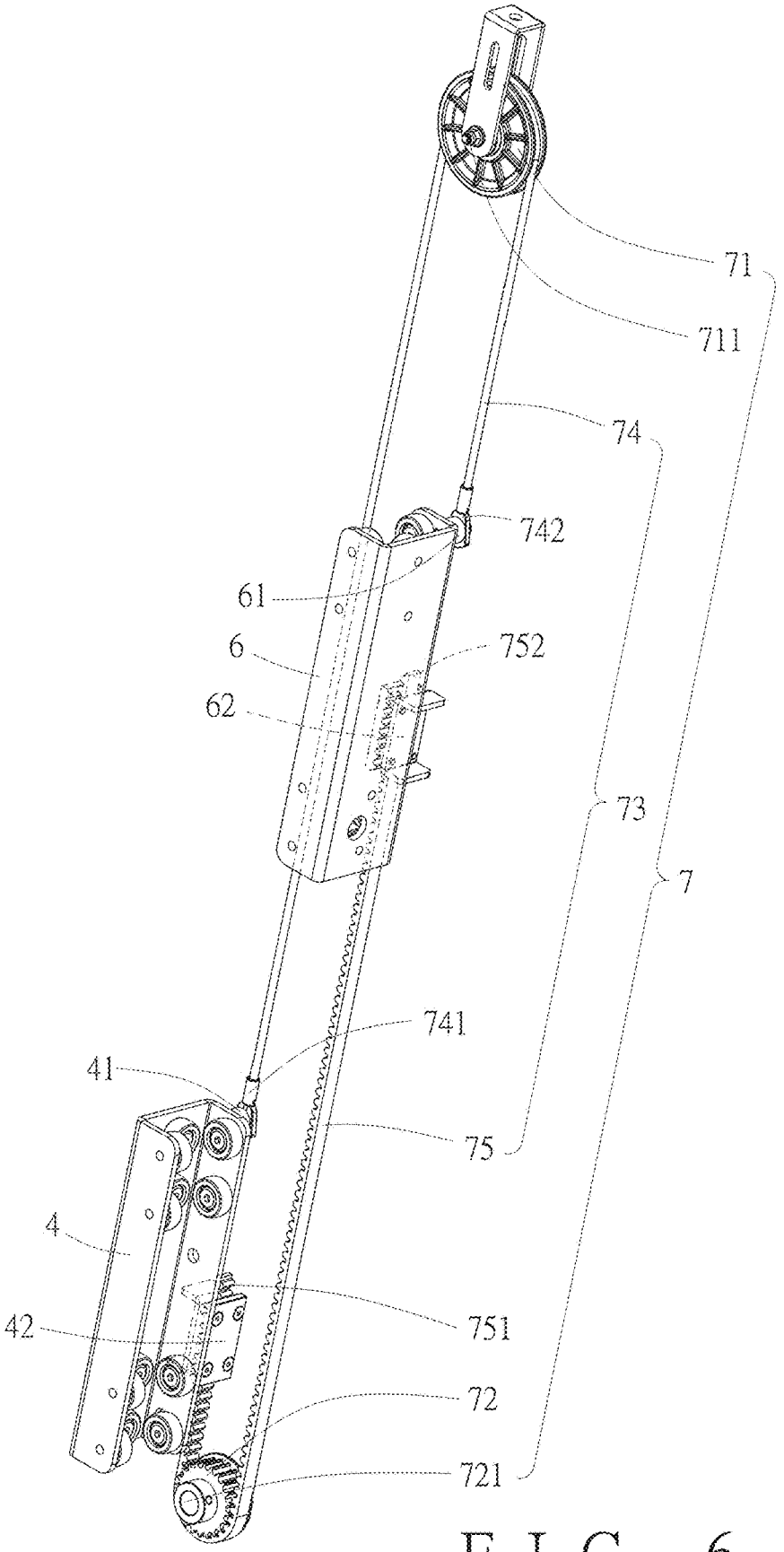
FIG. 6 is a three-dimensional assembly view of the embodiment of the present invention, showing that an upper transmission wheel, a lower transmission wheel and a transmission member are assembled together.
Figure 7:
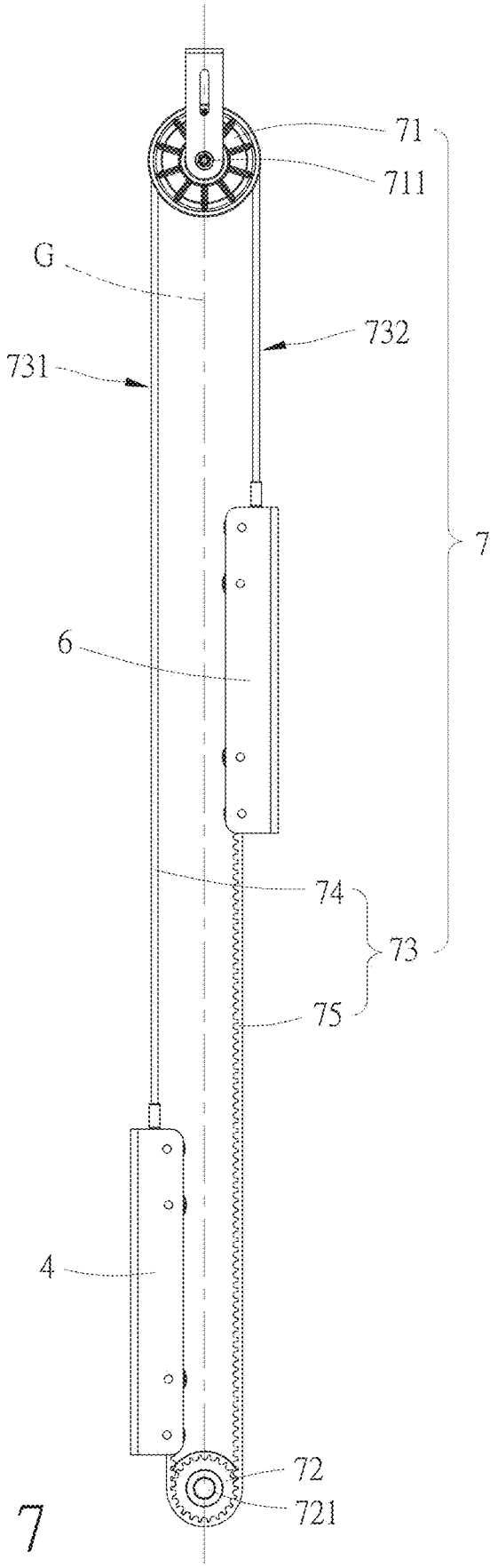
FIG. 7 is a schematic view of the embodiment of the present invention, showing that an axis connecting line divides the transmission member into a first section and a second section.
Figure 8:
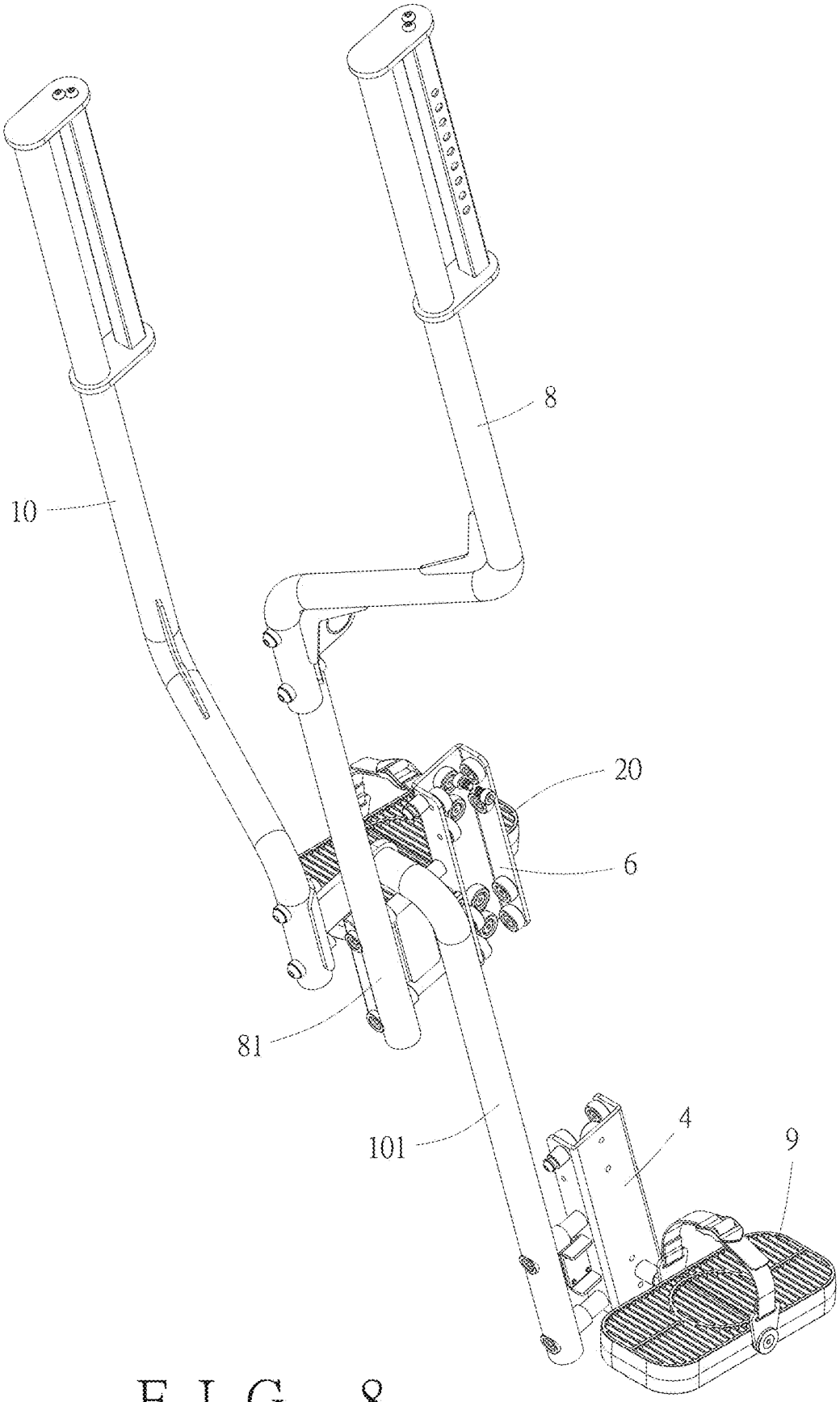
FIG. 8 is a three-dimensional view of the embodiment of the present invention, showing that the first slide base and the second slide base are fixed individually to a first handle, a first pedal, a second handle, and a second pedal.
Figure 9:
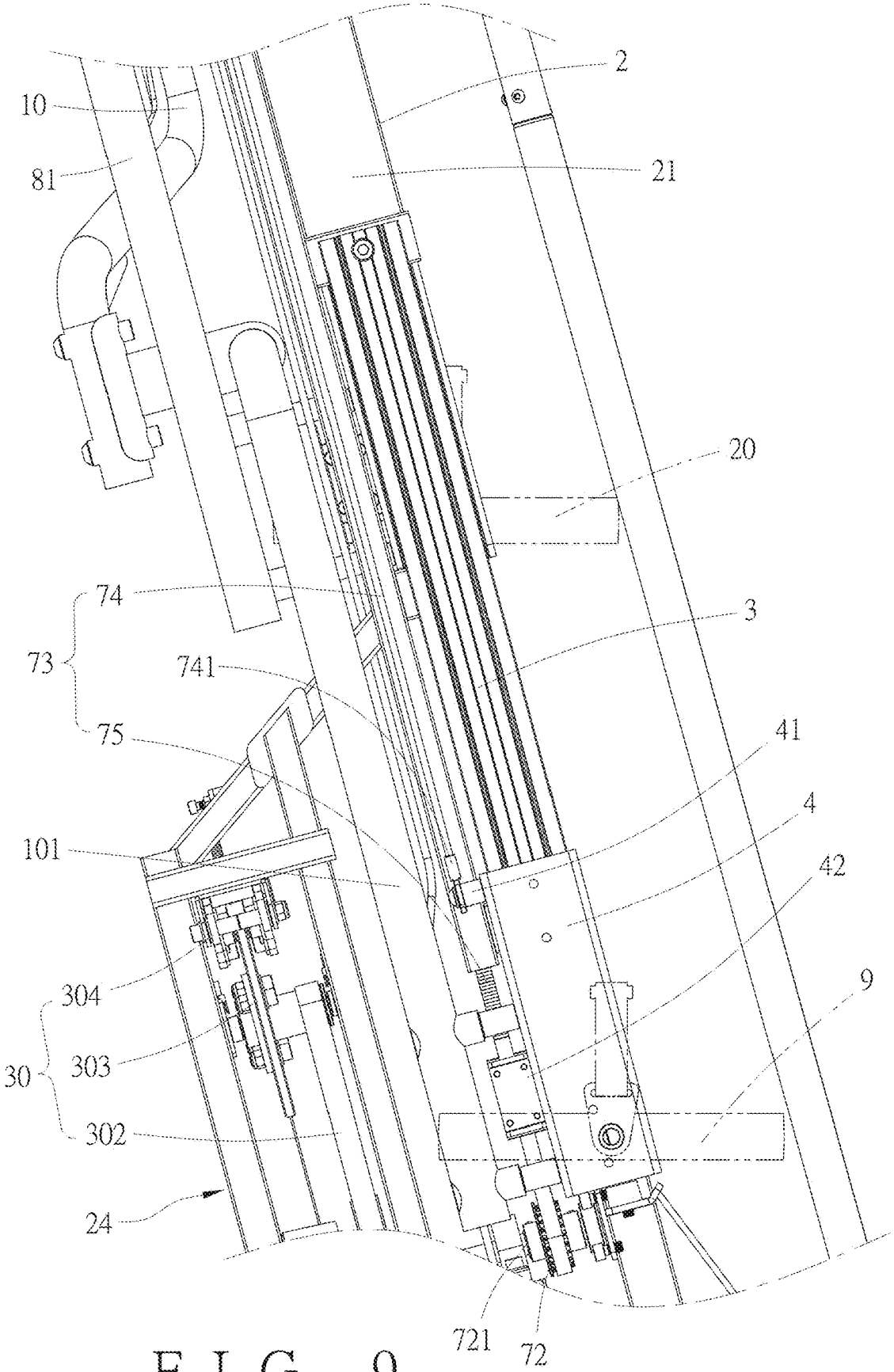
FIG. 9 is a schematic view of the embodiment of the present invention, showing that the first slide base slides on the first slide rail.
Figure 10:
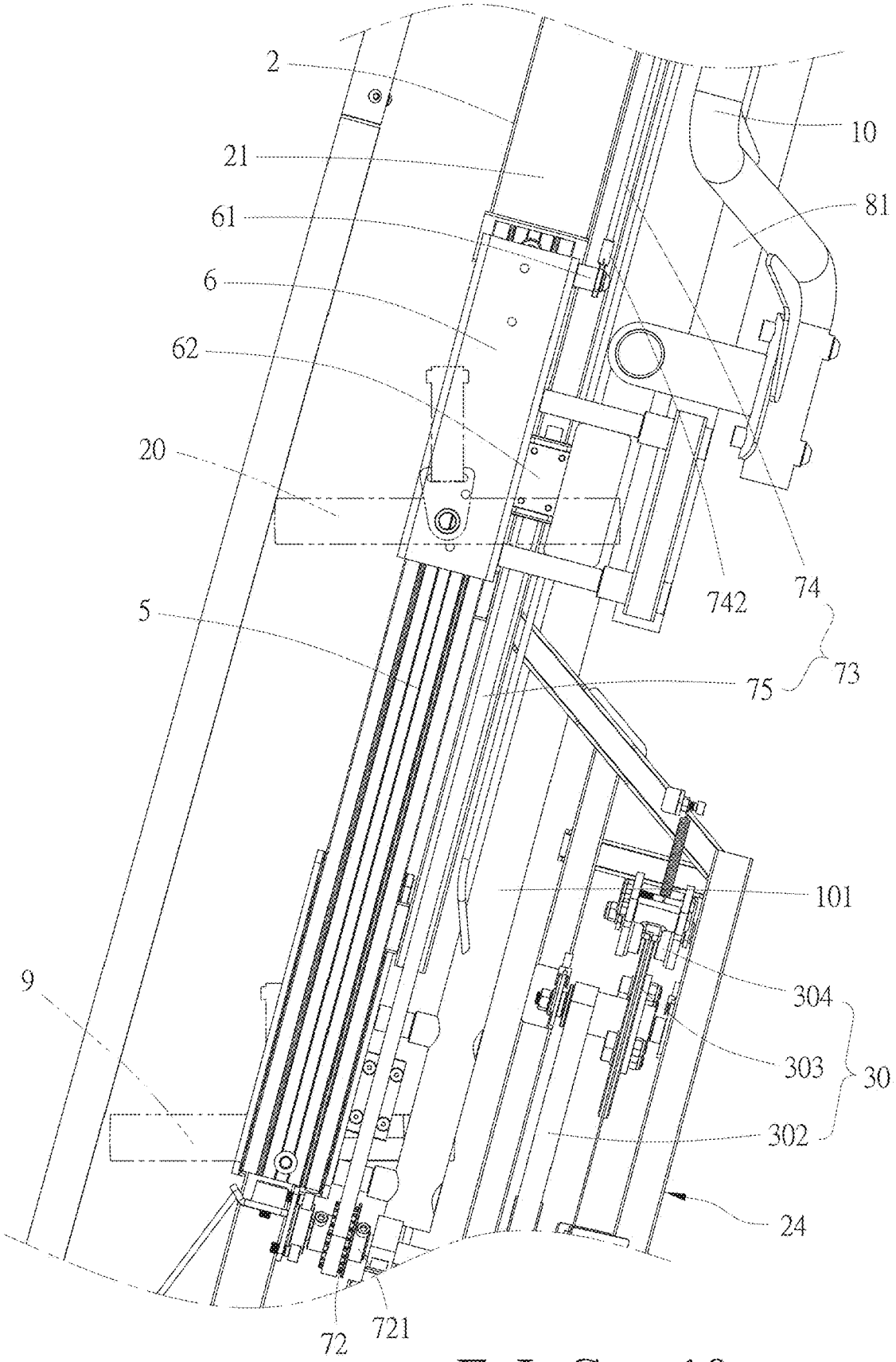
FIG. 10 a schematic view of the embodiment of the present invention, showing that the second slide base slides on the second slide rail.

Referring to FIG. 6 and FIG. 7, the upper transmission wheel 71 of the present embodiment is a cable pulley, and the first transmission piece 74 is a corresponding cable. The lower transmission wheel 72 is a timing belt pulley, and the second transmission piece 75 is a corresponding timing belt. An axis connecting line G between an axle center of the upper shaft 711 and an axle center of the lower shaft 721 divides the transmission member 73 into a first section 731 on the first side 21, and a second section 732 on the second side 22. The first slide base 4 is connected to the first section 731, and the second slide base 6 is connected to the second section 732. The lower transmission wheel 72 drives simultaneously the upper transmission wheel 71 to rotate back and forth in a limited degree by the transmission member 73, so as to drive the first slide base 4 and the second slide base 6 to slide on the first slide rail 3 and the second slide rail 5 in a direction opposite to each other.

Referring to FIG. 1, FIG. 8, FIG. 9 and FIG. 10, one end of the first handle 8 is fixedly connected to the second slide base 6 by a first link rod 81, and the other end of the first handle 8 is provided with a first grip 82 that can be adjusted upward and downward. The first grip 82 is disposed on the first side 21, and the first handle 8 provides for the user F to hold on with the left hand.

The first pedal 9 is fixedly connected to the first slide base 4 on the first side 21, and provides for the user F to step on with the left foot.

One end of the second handle 10 is fixedly connected to the first slide base 4 by a second link rod 101, and the second link rod 101 is in alternation with the first link rod 81. The first link rod 81 and the second link rod 82 will not interfere with each other during sliding. In addition, the other end of the second handle 10 is provided with a second grip 102 that can be adjusted upward and downward. The second grip 102 is disposed on the second side 22, and the second handle 10 provides for the user F to hold on with the right hand. As shown in FIG. 1, in the transversal direction X, a distance L between the first handle 8 and the second handle 10 is larger than a width W of the display unit 25, which avoids covering a line of sight for watching the display unit 25.

The second pedal 20 is fixedly connected to the second slide base 6 on the second side 22, and provides for the user F to step on with the right foot.

Referring to FIG. 1, FIG. 4, FIG. 4A and FIG. 6, the resistance unit 30 is disposed between the primary bracket 2 and the secondary bracket 24. The resistance unit 30 is connected to the transmission unit 7 to provide a resistance to the transmission unit 7. The resistance unit 30 includes a driving wheel 301, a belt 302, a resistance wheel 303, and a magnetic resistor 304, wherein the driving wheel 301 and the resistance wheel 303 are rotatably disposed between the primary bracket 2 and the secondary bracket 24. The driving wheel 301 is secured on the lower shaft 721 and rotates back and forth simultaneously along with the lower shaft 721. The belt 302 is sheathed between the driving wheel 301 and the resistance wheel 303, and the magnetic resistor 304 is pivoted on the secondary bracket 24. The magnetic resistor 304 can rotate by a limited angle opposite to the resistance wheel 303. By changing a relative position between the magnetic resistor 304 and the resistance wheel 303, the resistance of the resistance wheel 303 can be varied. The resistance wheel 303 transmits the resistance through the belt 302 and the driving wheel 301, and the resistance is transmitted to the first handle 8, the first pedal 9, the second handle 10 and the second pedal 20, through the transmission member 73, the first slide base 4 and the second slide base 6. The resistance wheel 303 of the present invention can be a magnetic resistor, a friction force resistor, an air resistor, a fluid resistor, a motor, or an electromagnetic brake resistor.

Figure 11:
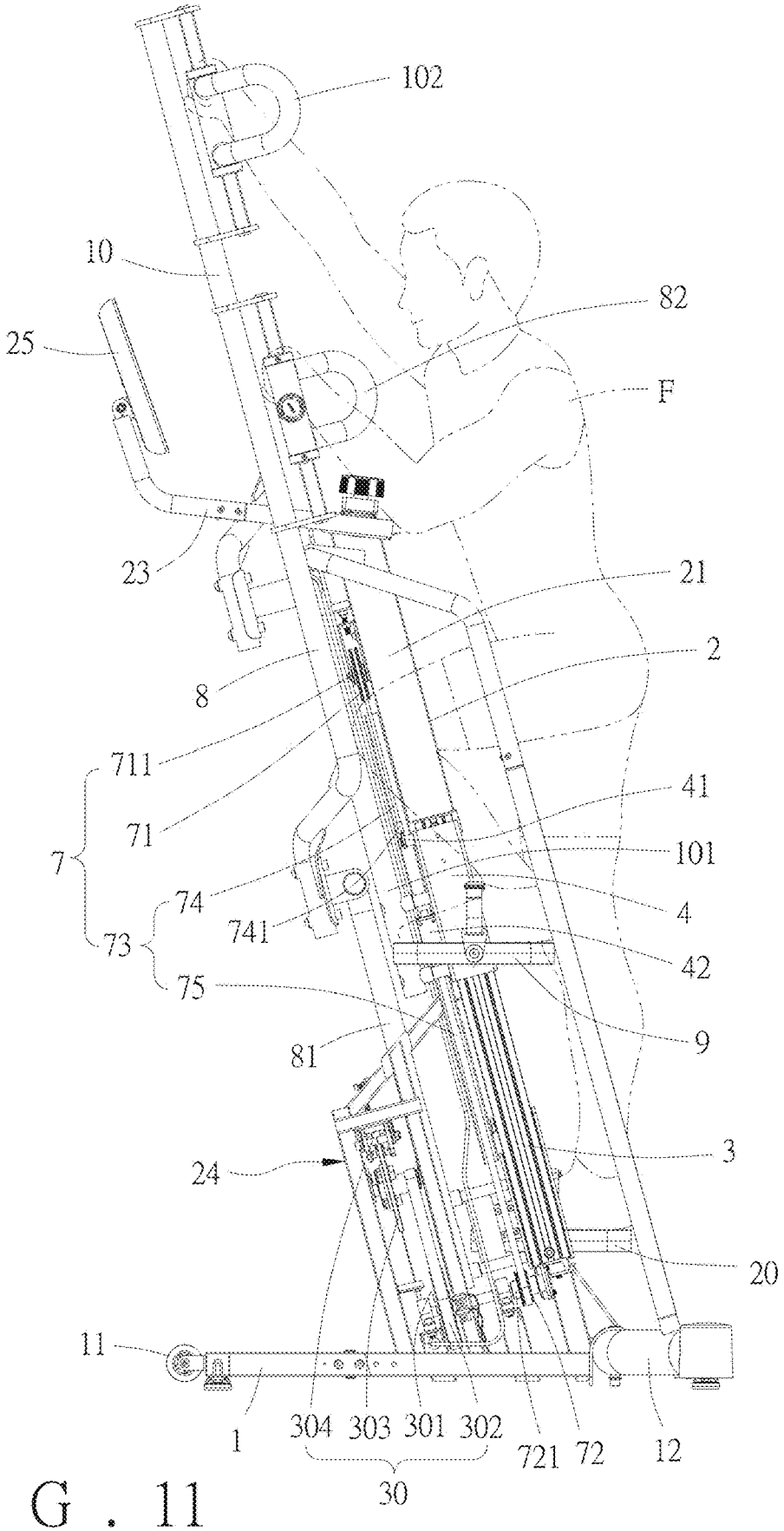
FIG. 11 is a schematic view of the embodiment of the present invention, showing that the first slide base drives the second handle and the first pedal to slide upward simultaneously.
Figure 12:
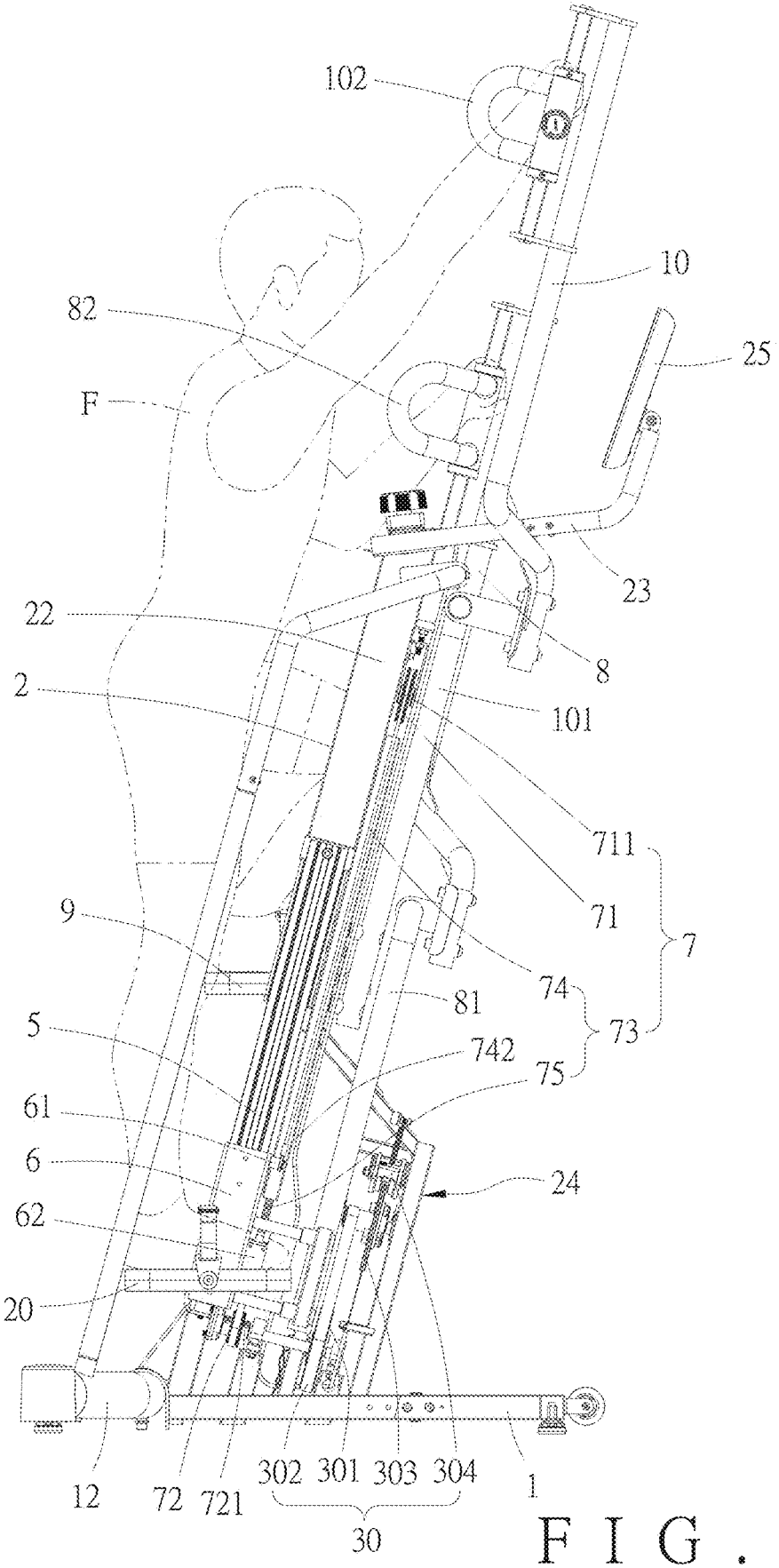
FIG. 12 a schematic view of the embodiment of the present invention, showing that the second slide base drives the first handle and the second pedal to slide upward simultaneously.

Upon using the climbing machine with two slide bases, as shown in FIG. 1, FIG. 11 and FIG. 12, the left foot of the user F steps on the first pedal 9 to apply a force, the right foot steps on the second pedal 20 to apply a force, the left hand holds on the first grip 82, and the right hand holds on the second grip 102. In operation, the left foot and the right foot of the user F step alternately and continuously. As the upper transmission wheel 71, the lower transmission wheel 72, and the transmission member 73 constitute a loop of connection, the upper transmission wheel 71 and the lower transmission wheel 72 will rotate back and forth simultaneously. The simultaneous back and forth rotation is a limited and continuous back and forth rotation, and is not a continuous rotation toward a same direction. Therefore, the first slide base 4 of the first section 731 and the second slide base 6 of the second section 732, with the first section 731 and the second section 732 being connected to the transmission member 73, will slide simultaneously in an opposite direction with respect to each other. When the left foot and the right foot of the user F step continuously and alternatively, the back and forth stroke of the first pedal 9 will drive the transmission member 73 to rotate back and forth in a limited degree, whereas the back and forth stroke of the second pedal 20 will also drive the transmission member 73 to rotate back and forth in a limited degree.

Referring to FIG. 1, FIG. 7, FIG. 11 and FIG. 12, as the second slide base 6 is combined to the second section 732 of the transmission member 73, the second pedal 20 and the first handle 8 are fixedly connected to the second slide base 6 together. When the user F steps downward with his or her right foot, the second section 732 will drive the second slide base 6 to slide downward on the second slide rail 5, and drive the second pedal 20 and the first handle 8 to move downward simultaneously, meaning that the right foot and the left hand of the user F move downward at a same time. At this time, the second section 732 drives the first section 731 to move upward, and as the first slide base 4 is combined to the first section 731 of the transmission member 73, the first pedal 9 and the second handle 10 are fixedly connected to the first slide base 4 together. Therefore, when the first slide base 4 moves upward, and drives the first pedal 9 and the second handle 10 to move upward simultaneously, the left foot and the right hand of the user F will move upward at a same time. Accordingly, when the right foot of the user F steps downward, the left hand of the user F will move downward at a same time, whereas the left foot and the right hand of the user F will move upward. By using the left foot and the right foot to step downward in turn, the left foot and the right hand, as well as the right foot and the left hand will move upward and downward separately for training. The simultaneously upward and downward movements of the right foot and the left hand, as well as the simultaneously upward and downward movements of the left foot and the right hand, conform the natural movements of the limbs.

Referring to FIG. 2, FIG. 3, FIG. 6 and FIG. 7, the first slide base 4 is disposed on the first side 21 of the primary bracket 2, and the second slide base 6 is disposed on the second side 22 of the primary bracket 2. The left foot of the user F applies a force to the first slide base 4, and the right foot of the user F applies a force to the second slide base 6, allowing the applied forces to be balanced on the first side 21 and the second side 22, which can stabilize the operation. In addition, as the first slide base 4 is fixed to the first section 731 of the transmission member 73, the second slide base 6 is fixed to the second section 732, the first pedal 9 is fixedly connected to the first slide base 4, and the first handle 8 is fixedly connected to the second slide base 6, the left foot and the left hand of the user F will always move away from each other and close to each other in operation. On the other hand, as the second pedal 20 is fixedly connected to the second slide base 6, and the second handle 10 is fixedly connected to the first slide base 4, the right foot and the right hand of the user F will always move away from each other and close to each other in operation, as well. Therefore, the left foot and the right hand of the user F can slide upward and downward simultaneously, and the right foot and the left hand can slide upward and downward simultaneously, conforming the movements of limbs in climbing. In the present invention, the primary bracket 2, the first slide rail 3, the first slide base 4, the second slide rail 5, the second slide base 6, and the transmission member 7, are all disposed on two sides of a center line of the vertical torso of the user F, and thus do not take up too much breadth. As these components are disposed between two legs of the user F, they will not interfere the operation and the size of the climbing machine can be reduced considerably.

Referring to FIG. 6 and FIG. 7, the first transmission piece 74 and the second transmission piece 75 can use a timing belt selectively; whereas, the upper transmission wheel 71 and the lower transmission wheel 72 can use a timing belt pulley selectively. Through the gnawing and transmission of the timing belt and the timing belt pulley, the transmission can be accurate, and the operation is smooth without slipping or causing vibration. In addition, the operation is quiet and has low noises, having an accurate transmission effect and a good transmission power.

Figure 13:
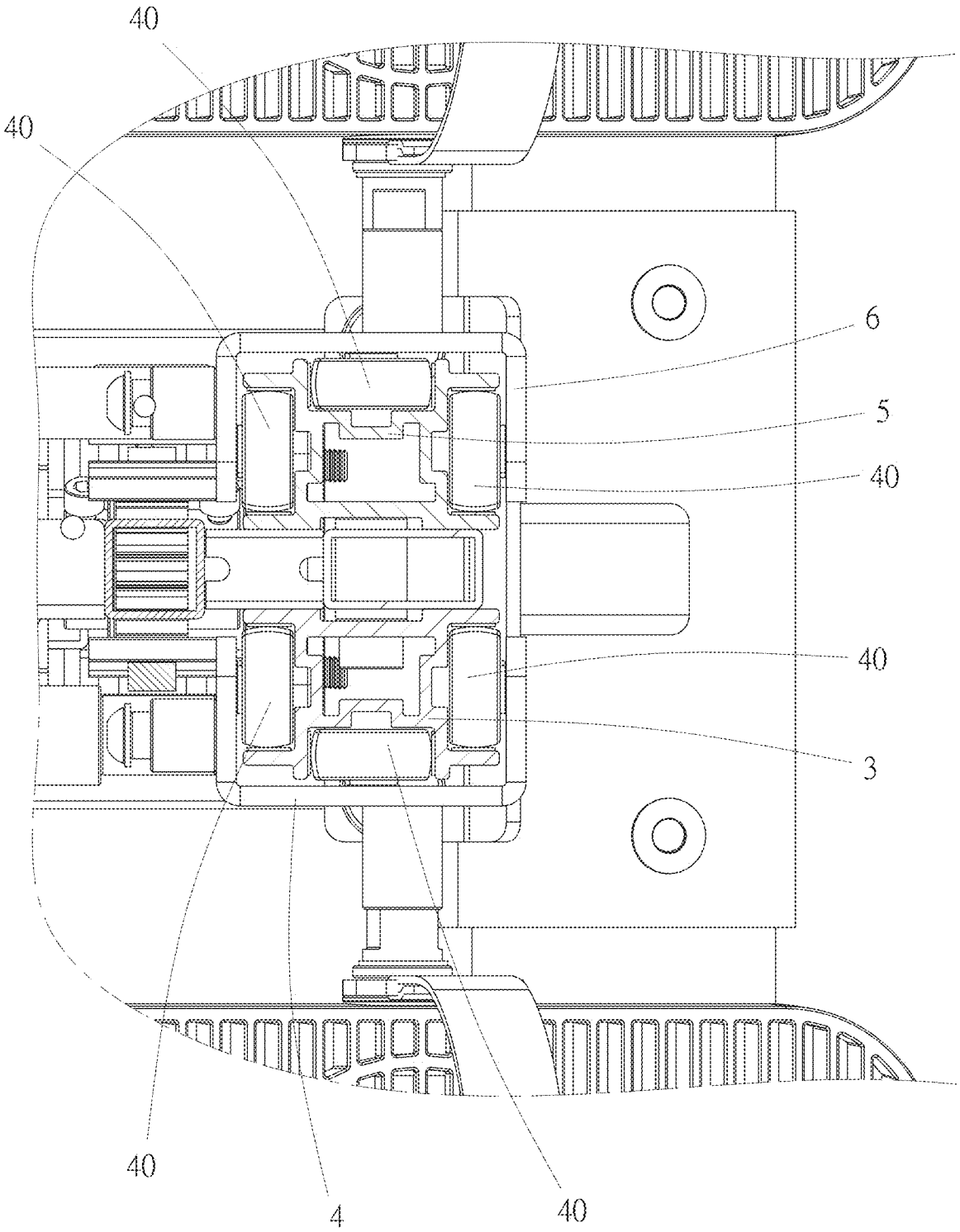
FIG. 13 shows a cutaway view along the line XIII-XIII in FIG. 1, according to the embodiment of the present invention.

Referring to FIG. 13, inner rims of the first slide base 4 and the second slide base 6 are provided respectively with three rollers 40. By the rollers 40, the first slide base 4 and the second slide base 6 slide on the first slide rail 3 and the second slide rail 5 respectively, thereby stabilizing the sliding.

Figure 14:
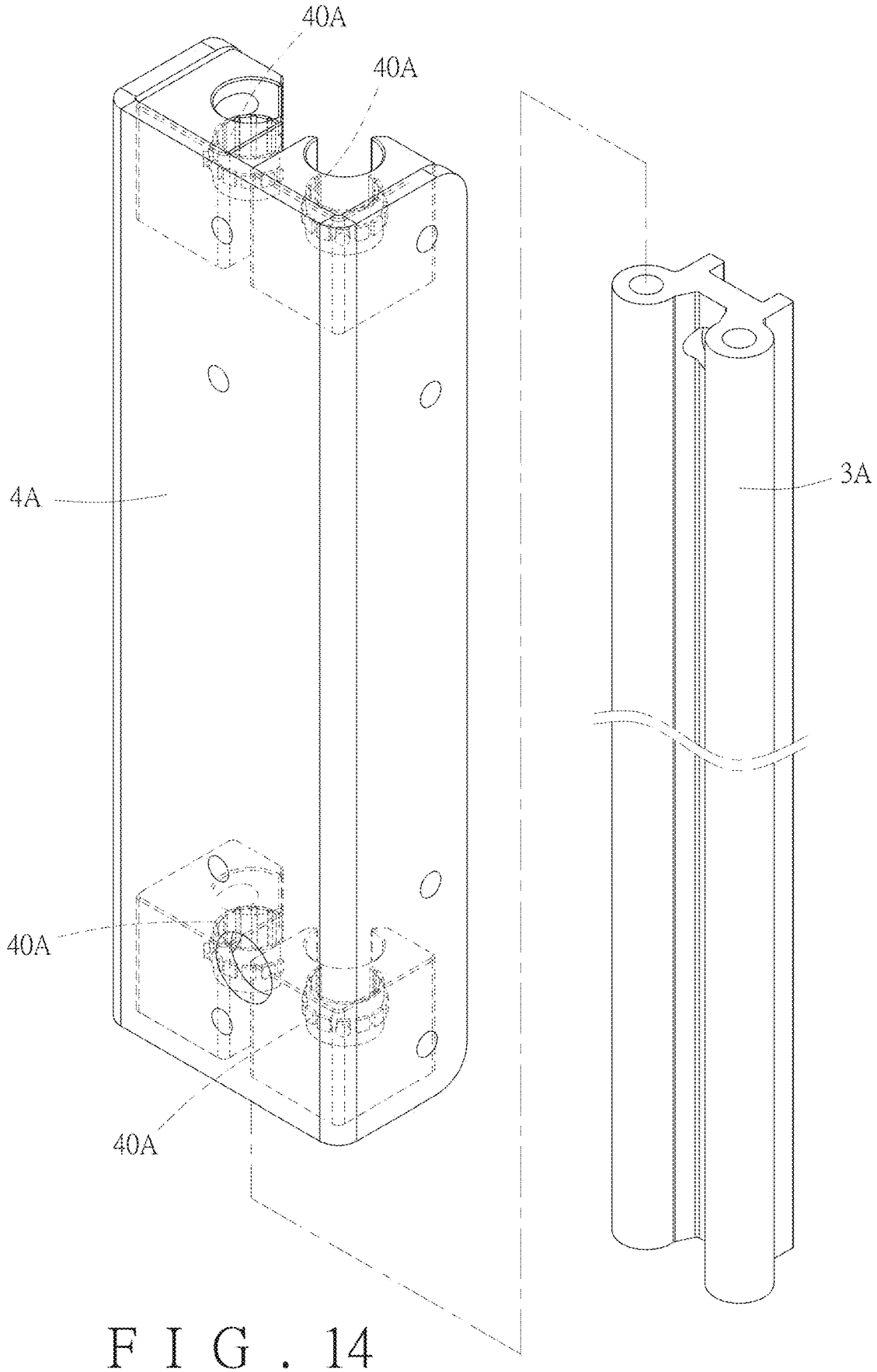
FIG. 14 shows a three-dimensional exploded view of another embodiment of the present invention.
Figure 15:
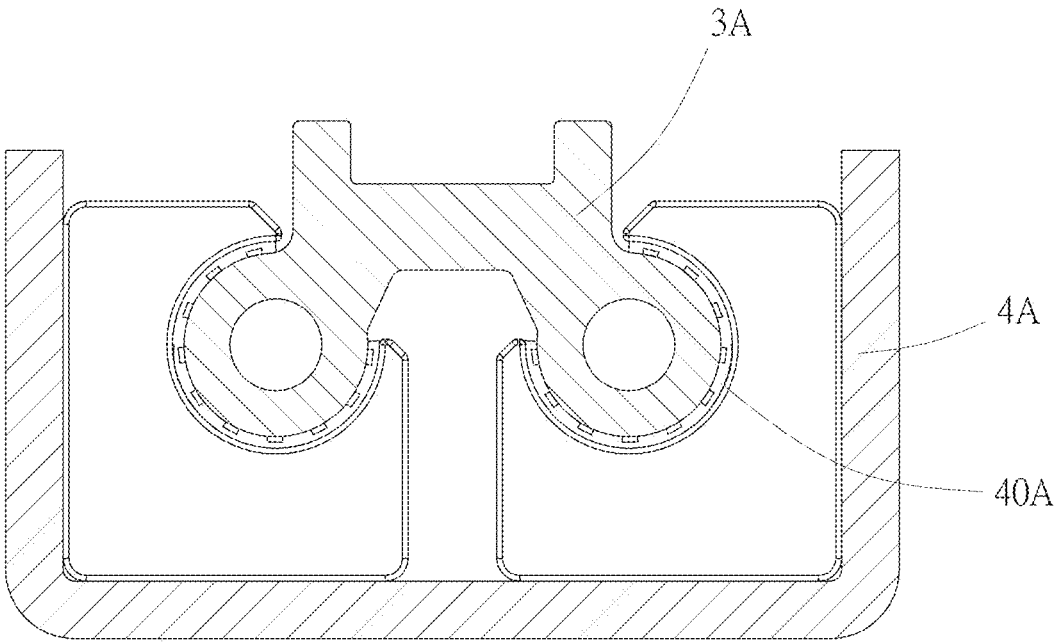
FIG. 15 shows a cutaway view of assembly of another embodiment of the present invention.

Referring to FIG. 14 and the FIG. 15, in another embodiment of the present invention, inner rims of a first slide base 4A and a second slide base are provided at least with a sleeve 40A which is used to replace the abovementioned rollers 40. In addition, a first slide rail 3A and a second slide rail are configured in a shape corresponding to the sleeve 40A, allowing the sleeve 40A to be sheathed on the first slide rail 3A and the second slide rail to slide, thereby reducing the noises in sliding.

The rollers 40, the first slide rail 3 and the second slide rail 5 in FIG. 13 ("roller-type slide rails"), and the sleeve 40A, the first slide rail 3A and the second slide rail ("sliding-type slide rails") in FIG. 14 and FIG. 15 (the second slide rail are not shown in the drawings), are all feasible embodiments of the present invention. Naturally, a mixed use of the abovementioned "roller-type slide rails" and the "sliding-type slide rails" can be also a feasible embodiment of the present invention.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. A climbing machine with two slide bases, being provided for a user to operate in a standing posture, with a direction to which the user's shoulder width extends while in operation being defined as a transversal direction, and comprising:

a seat;

a primary bracket, which is positioned with an upright direction on the seat and disposed on a central location on the seat in the transversal direction, and is divided into a first side and a second side in the transversal direction;

a first slide rail, which is fixed to the primary bracket on the first side along the upright direction of the primary bracket;

a first slide base, which is slidingly disposed on the first slide rail;

a second slide rail, which is fixed to the primary bracket on the second side along the upright direction of the primary bracket;

a second slide base, which is slidingly disposed on the second slide rail;

a transmission unit, which is disposed on the primary bracket, with the first slide base and the second slide base being connected respectively to the transmission unit to slide in a direction opposite to each other;

a first handle, which is provided with a first grip, with the first grip being disposed on the first side, and the first handle being fixedly connected to the second slide base;

a first pedal, which is fixedly connected to the first slide base on the first side;

a second handle, which is provided with a second grip, with the second grip being disposed on the second side, and the second handle being fixedly connected to the first slide base;

a second pedal, which is fixedly connected to the second slide base on the second side; and a resistance unit, which is disposed on the seat or the primary bracket, and is connected to the transmission unit to provide a resistance to the transmission unit, wherein the transmission unit comprises an upper transmission wheel, a lower transmission wheel and a transmission member, the upper transmission wheel is disposed on one end of the primary bracket, the lower transmission wheel is disposed on the other end of the primary bracket, the transmission member is sheathed between the upper transmission wheel and the lower transmission wheel, the first slide base and the second slide base are connected respectively to the transmission member, and the lower transmission wheel drives simultaneously the upper transmission wheel to rotate back and forth in a limited degree through the transmission member, thereby driving the first slide base and the second slide base to slide, wherein the upper transmission wheel is disposed on one end of the primary bracket by an upper shaft, and the lower transmission wheel is disposed on the other end of the primary bracket by a lower shaft, and wherein an axis connecting line between an axle center of the upper shaft and an axle center of the lower shaft divides the transmission member into a first section on the first side, and a second section on the second side, the first slide base is connected to the first section, and the second slide base is connected to the second section; wherein the seat is positioned additionally with a secondary bracket, the resistance unit is disposed between the primary bracket and the secondary bracket and comprises a driving wheel, a belt, a resistance wheel and a magnetic resistor, the driving wheel is fixed on the lower shaft to rotate back and forth along with the lower shaft, the driving wheel and the resistance wheel are rotatably disposed between the primary bracket and the secondary bracket, the belt is sheathed between the driving wheel and the resistance wheel, the magnetic resistor is rotatably disposed on the secondary bracket to allow the resistance wheel to acquire a changeable resistance, the resistance wheel transmits the resistance through the belt and the driving wheel, and the resistance is transmitted to the first handle, the first pedal, the second handle and the second pedal through the transmission member, the first slide base and the second slide base.

2. The climbing machine with two slide bases, according to claim 1, wherein the first slide base is oppositely provided with a first securing portion and a third securing portion, the second slide base is oppositely provided with a second securing portion and a fourth securing portion, the transmission member comprises a first transmission piece and a second transmission piece, the first transmission piece is sheathed on the upper transmission wheel, two ends of the first transmission piece are provided respectively with a first securing end and a second securing end, the first securing end is connected to the first securing portion, the second securing end is connected to the second securing portion, the second transmission piece is sheathed on the lower transmission wheel, two end of the second transmission piece are provided respectively with a third securing end a fourth securing end, the third securing end is connected to the third securing portion, and the fourth securing end is connected to the fourth securing portion.

3. The climbing machine with two slide bases, according to claim 2, wherein the upper transmission wheel and the lower transmission wheel are a timing belt pulley, a gear, a belt pulley, or a cable pulley.

4. The climbing machine with two slide bases, according to claim 2, wherein the first transmission piece and the second transmission piece are a timing belt, a chain, a belt, or a cable.

5. The climbing machine with two slide bases, according to claim 1, wherein one end of the first handle is fixedly connected to the second slide base by a first link rod, the first grip is fixed on the other end of the first handle by an upward and downward adjustable manner, one end of the second handle is fixedly connected to the first slide base by a second link rod, and the second grip is fixed on the other end of the second handle by an upward and downward adjustable movements.

6. The climbing machine with two slide bases, according to claim 1, wherein the primary bracket is provided with an auxiliary frame on an end away from the seat, the auxiliary frame is provided with a display unit at a location away from the user, and a distance between the first handle and the second handle is larger than a width of the display unit in the transversal direction.

7. The climbing machine with two slide bases, according to claim 1, wherein inner rims of the first slide base and the second slide base are provided respectively with at least a roller, thereby enabling the first slide base and the second slide base sliding on the first slid rail and the second slide rail respectively.

8. The climbing machine with two slide bases, according to claim 1, wherein inner rims of the first slide base and the second slide base are provided respectively with at least a sleeve, thereby enabling the first slide base and the second slide base sliding on the first slide rail and the second slide rail respectively.

* * * * *